US006786765B2

(12) United States Patent
Bauermeister et al.

(10) Patent No.: US 6,786,765 B2
(45) Date of Patent: Sep. 7, 2004

(54) INTELLIGENT CONNECTING PLUG FOR A DATA BUS

(75) Inventors: Ralf Bauermeister, Waiblingen (DE); Jürgen Gutekunst, Nürtingen (DE)

(73) Assignee: Murr-Elektronik GmbH, Oppenweiler (DE)

( * ) Notice: Subject to any disclaimer, the term of this patent is extended or adjusted under 35 U.S.C. 154(b) by 0 days.

(21) Appl. No.: 10/249,505

(22) Filed: Apr. 15, 2003

(65) Prior Publication Data

US 2004/0002256 A1 Jan. 1, 2004

(30) Foreign Application Priority Data

Apr. 15, 2002 (EP) ..... 02008525

(51) Int. Cl.[7] ..... H01R 13/60
(52) U.S. Cl. ..... 439/535; 439/188
(58) Field of Search ..... 439/535, 489, 439/188, 76.2, 76.1, 218, 736, 209, 320, 638, 928

(56) References Cited

U.S. PATENT DOCUMENTS 3,951,490 A * 4/1976 Devendorf ..... 439/63
4,985,845 A * 1/1991 Gotz et al. ..... 700/286
6,243,654 B1 6/2001 Johnson et al. ..... 702/85
6,291,770 B1 * 9/2001 Casperson ..... 174/72 A
6,468,092 B1 * 10/2002 Graff et al. ..... 439/76.1
6,515,228 B2 * 2/2003 Albert et al. ..... 174/52.3
6,527,599 B2 * 3/2003 Bechtold et al. ..... 439/736

FOREIGN PATENT DOCUMENTS

EP 0 807 999 11/1997
FR 2 788 379 7/2000

* cited by examiner

*Primary Examiner*—Gary Paumen
*Assistant Examiner*—Edwin A. Leon
(74) *Attorney, Agent, or Firm*—Gudrun E. Huckett

(57) ABSTRACT

A connecting plug for connecting an input/output unit to a machine control with a central bus, wherein the input/output unit is to be connected to a multi-strand electrical cable connected to a bus node, has a housing with a first plug connection for an incoming cable and a second plug connection for an outgoing cable. The incoming cable is looped through to the outgoing cable forming a looped-through cable. The housing has a connector for the input/output unit. An electronic device is arranged in the housing and connected to the connector. The connector is connected by the electronic device to the looped-through cable.

12 Claims, 4 Drawing Sheets

INTELLIGENT CONNECTING PLUG FOR A DATA BUS

BACKGROUND OF INVENTION

1. Field of the Invention.

The invention relates to a connecting plug for connecting an input/output unit, such as an actuator, a sensor, or the like, to a machine control comprising a central data bus, wherein the input/output unit is to be connected by the connecting plug to a multi-strand electric cable connected to a bus node.

2. Description of the Related Art

It is known to arrange terminal boxes in the data bus of a machine control which terminal boxes are in the form of bus nodes collecting the connecting cables of the connected actuators and sensors. For this purpose, it is necessary to connect each actuator and each sensor by its own cable to the terminal box. This means that a high material expenditure is required, and this also results in very thick cable harnesses which must be collected in corresponding cable pits and channels.

SUMMARY OF INVENTION

It is an object of the present invention to simplify the connection of sensors and actuators to a central data bus of a machine control.

In accordance with the present invention, this is achieved in that the housing of the connecting plug has a first plug connection for an incoming cable and a second plug connection for an outgoing cable wherein the incoming cable is looped through (connected through) to the outgoing cable and wherein the housing has a connector for the input/output unit, wherein the connector is connected by means of an electronic device arranged in the housing of the connecting plug to the looped-through cable.

By means of the first plug connection, the connecting plug is connected to the incoming cable which is looped through to the second plug connection to which devices can be connected downstream. In this way, several sensors and several actuators can thus be connected in series to the incoming cable wherein these input/output units can also be connected in a mixed arrangement to the same cable. The connecting plug has a connector for connecting it with the correlated input/output unit, wherein the connector is connected by means of an electronic device arranged in the housing of the connecting plug to the looped-through cable. In this way, it is made possible to control by means of the electronic device the connector in accordance with the connected input/output unit. The user can thus employ the same connecting plug for connecting sensors as well as for connecting actuators. This simplifies mounting.

The intelligent connecting plug recognizes by means of the electronic device integrated into the housing the connected unit and correspondingly connects the unit to the individual lines of the cable to the data bus.

In a first embodiment, the housing of the connecting plug is configured like a plug strip. In this connection, the connection to the connected input/output unit is embodied as a cable extending from the housing. The free outer end of the cable comprises a multi-terminal connecting plug for realizing a connection to the input/output unit. The plug is preferably a multi-terminal valve plug and serves for connecting an actuator unit which is in the form of a valve terminal. By configuring the free end of the connecting cable with a corresponding configuration of the multi-terminal valve plug, valve terminals of different manufacturers can be connected with the system.

It can be advantageous to configure the connector for the input/output unit as a plug connector which is mounted and secured in the housing so that the connecting plug can be plugged, without requiring an external connecting cable, directly onto the housing of an input/output unit such as a sensor or an actuator.

Advantageously, the electronic device in the housing of the connecting plug is cast in, particularly seal-tightly potted or embedded, so that even under rough environmental conditions a mechanical damage of the electronic device or unwanted effects caused by dirt, solvents or the like can be safely prevented. In this connection, the material which is used for potting the electronic device in the housing is preferably identical to the housing material of the connecting plug.

The connecting plug which is embodied correspondingly solidly, has a mounting opening which can be integrated within the housing. By means of the mounting opening, the connecting plug can be mechanically secured while at the same time the connected cable is fixed stationarily.

The embedded (cast-in) electronic device is provided with a light-emitting diode (LED) which serves as an optical display or indicator in the wall of the plug housing. By means of the electronic device, it is possible to perform a self-diagnosis of the connected input/output unit and to monitor the incoming and outgoing cables.

In order to be able to take into consideration different mounting situations, the plug connector in a side view is T-shaped or Y-shaped wherein the plug connector forms the bottom of the T or the Y and the plug connections are provided at the ends of the transverse beam of the T or the two upper ends of the Y.

DETAILED DESCRIPTION

Figure 1:
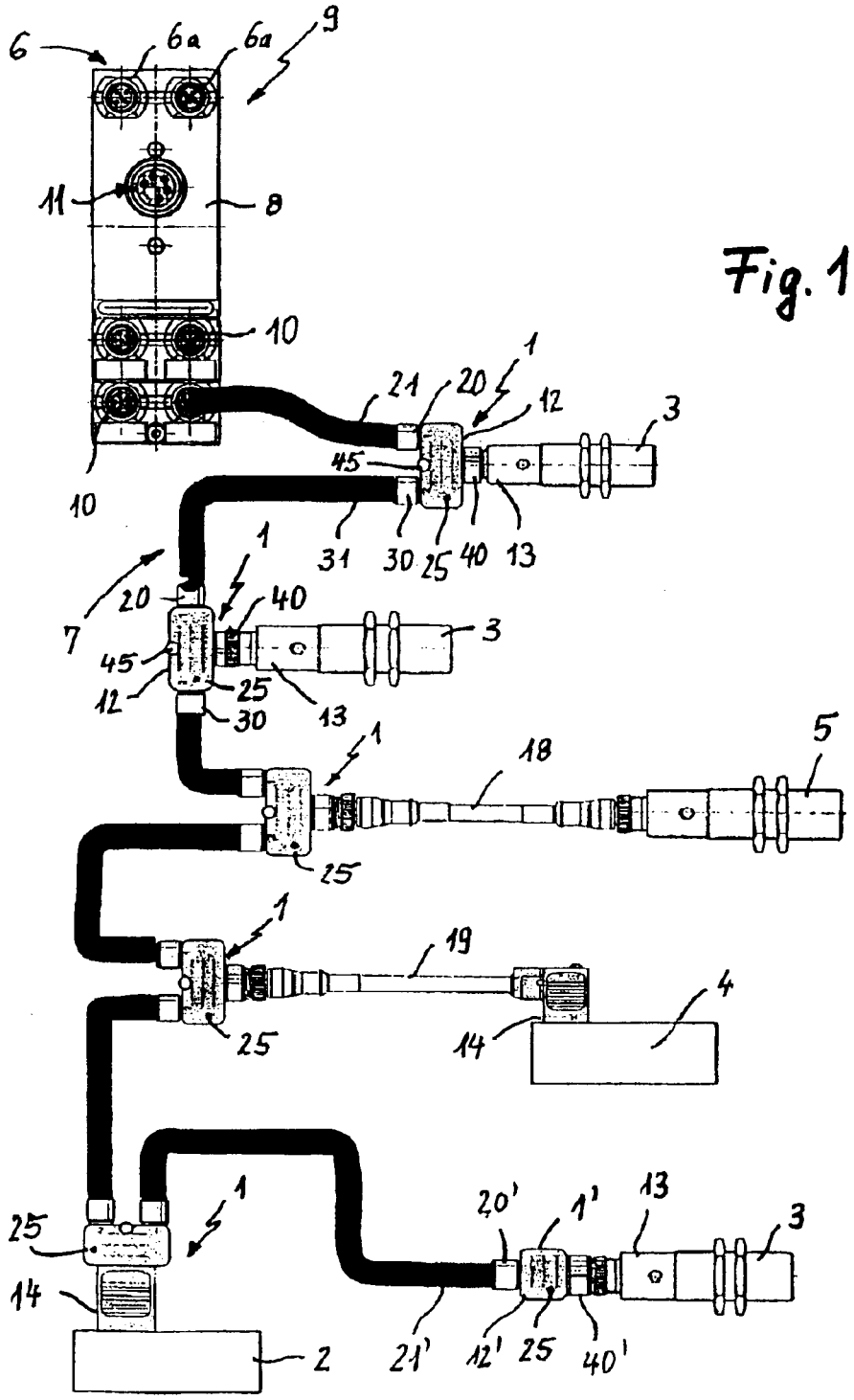
FIG. 1 is a schematic view of a bus node with connected sensors and actuators.
Figure 2:
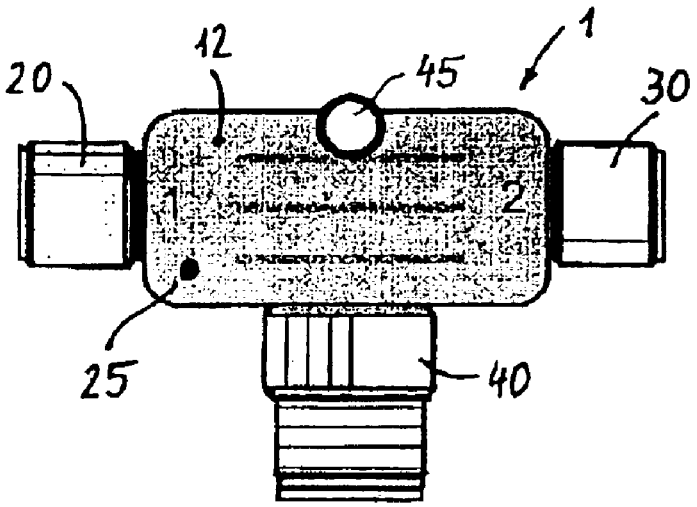
FIG. 2 is an enlarged illustration of the connecting plug according to the invention having a T shape.
Figure 3:
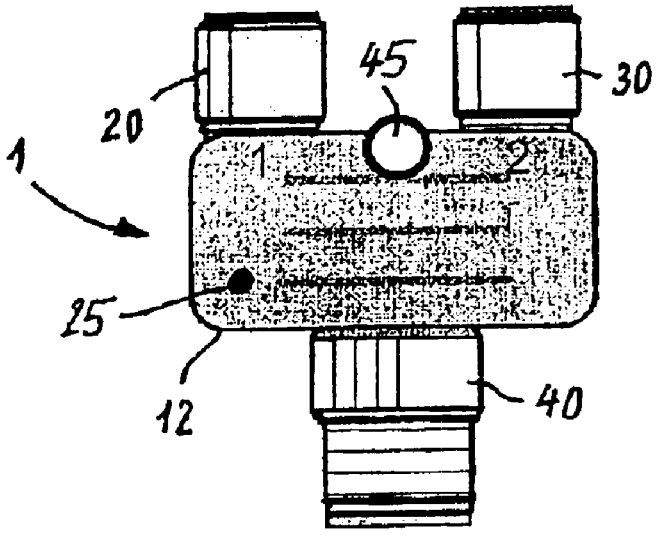
FIG. 3 is enlarged illustration of a connecting plug according to the invention having a Y shape.

The connecting plug 1 illustrated in FIGS. 1 through 3 serves for connecting the input/output units (I/O units) such as an actuator 2, 4 or a sensor 3, 5 to a central data bus 6 which is to be connected by means of plug 6*a*. Each one of the input/output units 2, 3, 4, 5 is connected by the connecting plug 1 with a multi-strand electric cable 7 which extends to the terminal box 8. The terminal box 8 connects as a bus node 9 a plurality of input/output units by means of plug 10 to the data bus 6.

In addition to the data bus 6, an energy connector 11 for supplying voltage to the sensors 3, 5 and actuators 2, 4 is provided by means of the terminal box 8. The required operating voltage $U_{actuator}$ and $U_{sensor}$ is also supplied by cable 7 which is embodied particularly as a six-strand cable 7.

As illustrated in FIG. 1, and in FIGS. 2 and 3 in greater detail, the housing 12 of the connecting plug 1 has a first plug connection 20 for an incoming cable 21 as well as a second plug connection 30 for an outgoing cable 31. As shown in the schematic illustration of FIG. 4, the incoming cable arriving at the first plug connection 20 is looped through, without interruption, to the second outgoing plug connection 30.

The housing 12 of the plug connection 1 has also a plug connector 40 to which is connected an input/output unit 2, 3, 4, 5. In this connection, the plug connector 40 can be plugged directly onto the housing 13 of the sensor 3, 5 or the housing 14 of the actuator 2, 4. The connecting plug 1 is thus securely plugged directly onto the housing 13, 14 of the input/output units.

The plug connector 40 is electrically connected by means of an electronic device 15 that is arranged in the housing 12 to the looped-through cable 7. The plug connector 40 is properly configured by means of a central microprocessor 16 wherein the electronic device 15 recognizes automatically whether a sensor 3, 5 or an actuator 2, 4 is connected. Correspondingly, the connecting lines 17 are switched so that the user is only required to connect the intelligent connecting plug with the sensor 3, 5 or actuator 2, 4; additional adjusting measures are not required.

While the housing 12 remains unchanged, the connecting plug 1 can be embodied as a T-connector (FIG. 2) or can have the shape of a Y (FIG. 3). In this way, a suitable plug can be selected for any location of use.

As illustrated in FIG. 1, by means of the intelligent connecting plug 1 more than one actuator or sensor can be connected to a plug 10 of the terminal box 8 of the bus node 9. The bus and energy cable 7 is looped through each connecting plug 1 so that by means of the cable 7 several sensors 3, 5 and actuators 2, 4 can be operated in parallel. It is important in this connection that to the same cable input units, such as sensors, as well as output units, such as actuators, can be connected in a mixed arrangement.

For certain applications it can be required to arrange the intelligent connecting plug 1 at a spacing from the sensor 5 or actuator 4 wherein the spacing can be bridged by a corresponding connecting cable 18 or 19. In this way, the intelligent connecting plug 1 can still be employed in tight mounting situations. In order to be able to secure the connecting plug 1, as needed, in the housing 12 of the connecting plug 1, a mounting opening 45 is provided through which a fastening screw or a similar fasting element can be guided.

The electronic device 15 is configured such that the microprocessor 16 controls an optical display in the form of an LED 25. The LED expediently is recessed in the wall of the housing 12 of the connecting plug 1. In this way, it is possible to indicate on the connecting plug 1 whether the connected actuator 2, 4 or sensor 3, 5 has operating problems. At the same time, by means of the LED 25 the proper operating state of the outgoing cable can be indicated. In this way, the user can determine, without complex technical measures, whether and where errors occur by simply performing a control walk along the cable 7.

For diagnosing the connected cables 21, 31 and/or of the plugged-in sensors 3, 5 or actuators 2, 4, a diagnosis unit 26 is integrated in the microprocessor 16. The connecting lines 17 are connected to an input module 28 which is controlled by the microprocessor 16. The connecting lines 17 are also switchable as outputs by means of electronic switches 27 and an output module 29.

In order to be able to use a connecting plug and the electronic device arranged therein also in rough operational surroundings, the electronic device 15 is to be embedded (cast in) within the housing of the connecting plug 1, in particular, embedded in a seal-tight way. In order to ensure that the LED 25 is not completely surrounded by the dark material of the housing 12, a small droplet of clear silicone is applied to the LED for compensating tolerances. When the electronic device 15 is inserted into the injection mold, the silicone droplet compensates possible tolerances. The dark material of the housing which is used at the same time for embedding the electronic device 15, cannot completely enclose the LED so that optical recognition from the exterior is ensured. The measure of providing a droplet of silicone on the LED or any other optical display before injection molding the electronic device is in and of itself of particular importance in regard to manufacturing technology. The concept of applying silicone droplets is generally advantageously usable in manufacturing independent of the present invention concerning a connecting plug.

In order to provide a seal-tight embodiment of the connecting plugs 20, 30 and the plug connector 40, threaded connections, for example, of the size M12, can be provided. In this way the International Protection Rating IP 67 is ensured.

The individual sensors 3, 5 and actuators 2, 4 are recognized in the data bus 6 by their own address wherein the own address is assigned by the system when starting up the control device. In order to enable during startup of the device the addressing function, it is provided to interrupt the voltage supply of the downstream intelligent connecting plug by an electronic switch 23. The voltage supply of the microprocessor 16 is tapped between the incoming plug connection 20 and the electronic switch 23 so that only the first plug connection 1 in the cable 7 is supplied with voltage. After the first connecting plug on the cable 7 has been provided with an address by the machine control and the sensor 3 connected thereto is assigned by means of this address within the system, the electronic switch 23 is controlled by the microprocessor 16 and closed so that the next connecting plug 1 in the series along the cable 7 is supplied with voltage. Now the next connecting plug is provided with its address in the same way, and, after completion of address assignment, the electronic switch 23 provided in this plug is closed by the microprocessor 16 so that the next sequentially arranged connecting plug 1 is supplied with voltage. In this way, all sensors and actuators connected to the cable 7 are sequentially provided with addresses and are assigned according to their addresses within the system.

The last connecting plug 1 closes off the cable 7. Accordingly, its housing 12' only has one plug connection 20' for the incoming cable 21' and a plug connector 40' for the sensor 3. The outgoing plug connection is eliminated.

Figure 5:
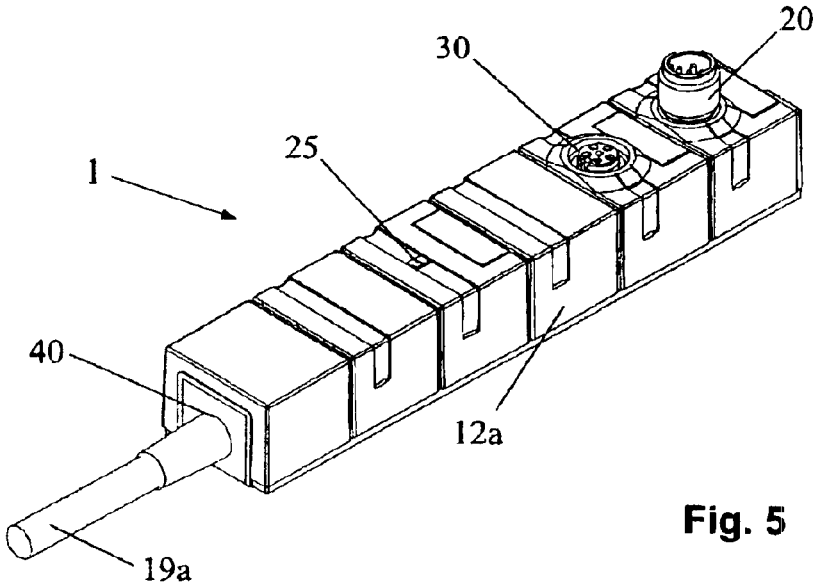
FIG. 5 is a perspective illustration of the connecting plug in the form of a connecting strip with a connecting cable.
Figure 6:
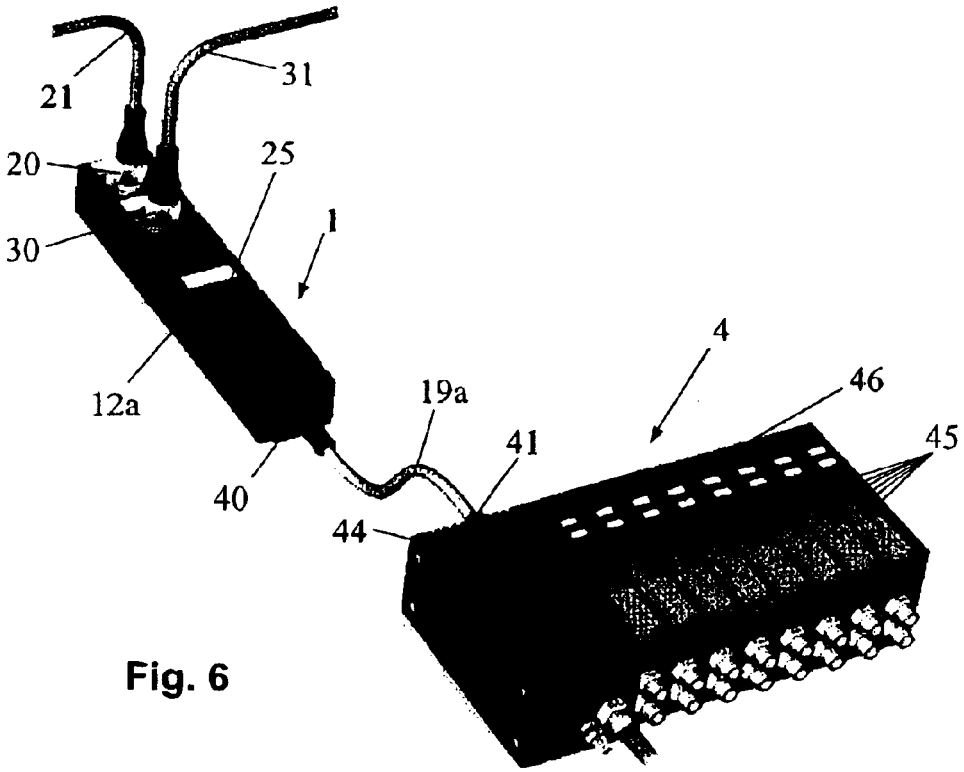
FIG. 6 is schematic illustration of a connecting plug connected to a data bus in the form of a strip connector with connected valve terminal.

In the embodiment according to FIGS. 5 and 6, a connecting plug 1 is configured in the form of a connecting strip wherein at one end sequentially the plug connection 20 for the incoming cable 21 and the plug connection 30 for the outgoing cable 31 are provided in a row. The plug connection 20 is a plug while the plug connection 30 is a socket.

On the end face of the elongate parallelepipedal connecting strip facing the plug connectors 20 and 30, the connector 40 is provided in the housing 12*a*. In the shown embodiment according to FIGS. 5 and 6, it is comprised of a preferably 25-pin connecting cable 19*a* whose free end 41 supports a connecting plug 44. The connecting plug 44 is preferably a multi-terminal valve plug and serves for connecting an actuator unit 4 embodied as a valve terminal. The valve terminal is comprised of several switching valves 45, in the embodiment comprised of eight adjacently positioned valves, which are secured in a common valve bank 46.

The valve plug 1 configured as a connecting strip is connected by means of the internal system connection with the higher-ranking bus system and enables a direct connection of the multi-terminal valve terminal. By properly designing the connecting cable 19*a*, different plug systems of different valve manufacturers can be connected.

Figure 4:
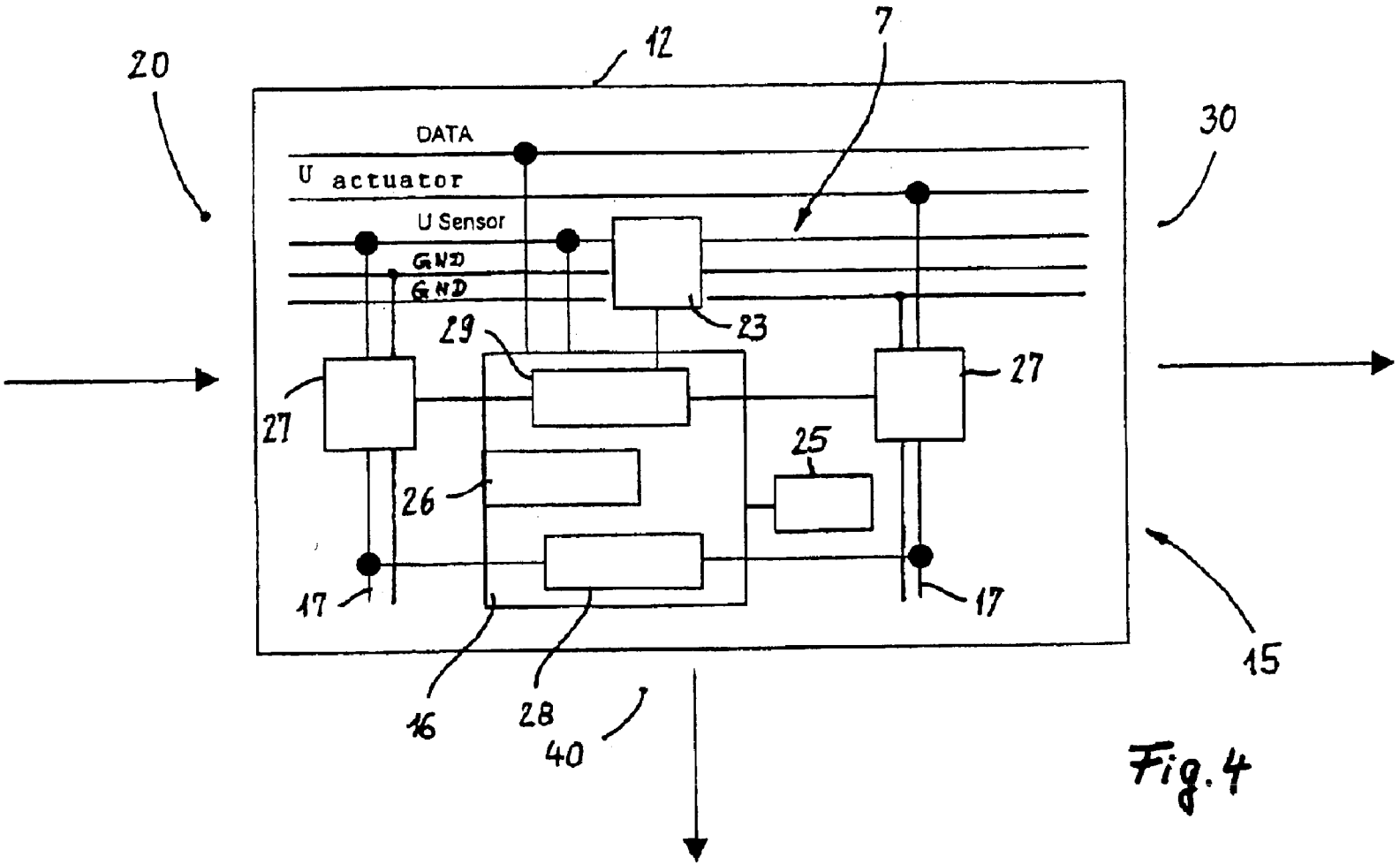
FIG. 4 is a schematic illustration of a connecting plug with integrated active electronic device in the housing of the connecting plug.

As illustrated in FIG. 4, the electronic device integrated into the connecting strip 1 enables an electrical wire breakage (open circuit) recognition. Each of the connected channels is monitored individually with regard to short-circuiting. The maximum channel number is sixteen in this embodiment. An error, for example, short-circuit or wire breakage, is indicated by the electronic device by means of, for example, a red LED 25 on the topside of the housing 12*a*. In addition, each error can also individually be sent as readable text to the internal system or a higher-ranking system.

While specific embodiments of the invention have been shown and described in detail to illustrate the inventive principles, it will be understood that the invention may be embodied otherwise without departing from such principles.

What is claimed is:

1. A connecting plug for connecting an input/output unit to a machine control comprising a central bus, wherein the input/output unit is to be connected to a multi-strand electrical cable connected to a bus node, the connecting plug comprising:

a housing (12, 12*a*) comprising a first plug connection (20) for an incoming cable (21) and a second plug connection (30) for an outgoing cable (31), wherein the incoming cable (21) is looped through to the outgoing cable (31) forming a looped-through cable (7);

the housing (12, 12*a*) comprising a connector (40) for the input/output unit (2, 3, 4, 5);

an electronic device (15) arranged in the housing (12, 12*a*) and connected to the connector (40);

wherein the connector (40) is connected by the electronic device (15) to the looped-through cable (7);

wherein the electronic device (15) comprises en electronic switch (23) which interrupts a voltage supply to the plug connection (30) of the outgoing cable (31) in a rest position of the connecting plug (1) and the electronic switch (23) is closed by the electronic device (15) when the connecting plug (1) has been assigned an address by the machine control.

2. The connecting plug according to claim 1, wherein the connector (40) is a plug connector secured in the housing (12).

3. The connecting plug according to claim 1, wherein the housing has an integrated mounting opening (45).

4. The connecting plug according to claim 1, configured to be placed directly onto the housing (12) of the input/output unit.

5. The connecting plug according to claim 1, wherein the housing (12*a*) is a plug strip and the connector (40) is a connecting cable extending from the housing (12*a*), wherein the free end (41) of the connecting cable has a multi-terminal connector plug.

6. The connecting plug according to claim 5, wherein the multi-terminal connector plug is a multi-terminal valve plug.

7. The connecting plug according to claim 1, wherein the electronic device (15) in the housing (12) of the connecting plug is cast in.

8. The connecting plug according to claim 7, wherein the electronic device (15) is seal-tightly cast in.

9. The connecting plug according to claim 1, wherein the housing (12) comprises en optical display.

10. The connecting plug according to claim 9, wherein the optical display is an LED (25) arranged in a wall of the housing (12).

11. The connecting plug according to claim 10, wherein the LED is wetted by a droplet of silicone before the electronic device (15) is cast in.

12. The connecting plug according to claim 1, wherein, when viewed in a side view, the housing (12) with the plug connections (20,30) and the plug connector (40) has approximately a T-shape or a Y-shape.

* * * * *